US012670126B2

(12) United States Patent
Cao et al.

(10) Patent No.: US 12,670,126 B2
(45) Date of Patent: Jun. 30, 2026

(54) METHOD, APPARATUS, DEVICE, AND READABLE MEDIUM FOR DOCUMENT QUERY

(71) Applicants: Beijing Youzhuju Network Technology Co., Ltd., Beijing (CN); Lemon Inc., Grand Cayman (KY)

(72) Inventors: Qian Cao, Beijing (CN); Zhiwei Cao, Beijing (CN); Shanbo Cheng, Singapore (SG)

(73) Assignees: BEIJING YOUZHUJU NETWORK TECHNOLOGY CO., LTD., Beijing (CN); LEMON INC., Grand Cayman (KY)

( * ) Notice: Subject to any disclaimer, the term of this patent is extended or adjusted under 35 U.S.C. 154(b) by 0 days.

(21) Appl. No.: 19/017,199

(22) Filed: Jan. 10, 2025

(65) Prior Publication Data

US 2025/0147929 A1 May 8, 2025

(30) Foreign Application Priority Data

Jan. 25, 2024 (CN) ..... 202410109020.6

(51) Int. Cl.
*G06F 16/00* (2019.01)
*G06F 16/174* (2019.01)
*G06F 16/93* (2019.01)

(52) U.S. Cl.
CPC ..... *G06F 16/1744* (2019.01); *G06F 16/93* (2019.01)

(58) Field of Classification Search
None
See application file for complete search history.

(56) References Cited

U.S. PATENT DOCUMENTS 6,307,962 B1 * 10/2001 Parker ..... G06T 9/00 382/237
8,856,123 B1 * 10/2014 Forman ..... G06F 16/31 706/12
10,909,320 B2 * 2/2021 Bull ..... G06F 40/279
11,295,090 B2 4/2022 Awadallah et al.
(Continued)

FOREIGN PATENT DOCUMENTS

CN 115391478 A * 11/2022 ..... G06F 16/55
CN 116467411 A 7/2023
CN 117094401 A 11/2023

*Primary Examiner* — Hasanul Mobin
(74) *Attorney, Agent, or Firm* — Astute IP Law Group

(57) ABSTRACT

The disclosure provide a method and apparatus for document query, a device, and a readable medium. The method includes: determining, for a candidate document of a target question, a plurality of importance degrees of a plurality of document segments in the candidate document relative to the target question; determining, based on the respective importance degrees of the plurality of document segments, respective compression ratios for the plurality of document segments; compressing respective feature representations of the plurality of document segments based on the respective compression ratios for the plurality of document segments to obtain a compressed feature representation of the candidate document; and determining a target answer to the target question based on the compressed feature representation of the candidate document using a trained target model.

16 Claims, 5 Drawing Sheets

(56) References Cited

U.S. PATENT DOCUMENTS

| | | | | |
|---|---|---|---|---|
| 2007/0061356 | A1* | 3/2007 | Zhang | G06F 16/345 707/999.102 |
| 2010/0283589 | A1* | 11/2010 | Kawai | H04N 19/63 382/284 |
| 2011/0052045 | A1* | 3/2011 | Kameyama | G06T 7/75 382/154 |
| 2013/0021346 | A1* | 1/2013 | Terman | G09B 5/08 345/467 |
| 2016/0335261 | A1* | 11/2016 | Salvetti | G06F 16/2455 |
| 2021/0303796 | A1* | 9/2021 | Elsahar | G06F 40/30 |
| 2024/0070204 | A1* | 2/2024 | Prakash | G06N 5/04 |
| 2024/0411790 | A1* | 12/2024 | Cui | G06F 16/3329 |
| 2025/0335792 | A1* | 10/2025 | Liu | G06F 16/906 |

* cited by examiner

METHOD, APPARATUS, DEVICE, AND READABLE MEDIUM FOR DOCUMENT QUERY

CROSS-REFERENCE

The present application claims priority to Chinese Patent Application No. 202410109020.6, filed on Jan. 25, 2024 and entitled "METHOD, APPARATUS, DEVICE, AND READABLE MEDIUM FOR DOCUMENT QUERY", the entirety of which is incorporated herein by reference.

FIELD

Example embodiments of the present disclosure generally relate to the field of computers, and in particular to a method, apparatus, a device, and a computer-readable storage medium for document query.

BACKGROUND

With the development of information technology, various terminal devices may provide people with various services in terms of work and life. Applications that provide services may be deployed in terminal devices. Terminal devices present corresponding content through a user interface of an application and implement interaction with a user to meet various needs of the user. In some cases, the user may initiate a data query request in the application. In this case, it is necessary to return a query response expected by the user in combination with a corresponding knowledge base. Therefore, there is a focus on improving the quality of query services provided to users.

SUMMARY

In a first aspect of the present disclosure, a method for document query is provided. The method includes: determining, for a candidate document of a target question, a plurality of importance degrees of a plurality of document segments in the candidate document relative to the target question; determining, based on respective importance degrees of the plurality of document segments, respective compression ratios for the plurality of document segments; compressing respective feature representations of the plurality of document segments based on the respective compression ratios for the plurality of document segments to obtain a compressed feature representation of the candidate document; and determining a target answer to the target question based on the compressed feature representation of the candidate document using a trained target model.

In a second aspect of the present disclosure, an apparatus for document query is provided. The apparatus includes: an importance degree determination module configured to determine, for a candidate document of a target question, a plurality of importance degrees of a plurality of document segments in the candidate document relative to the target question; a compression ratio determination module configured to determine, based on respective importance degrees of the plurality of document segments, respective compression ratios for the plurality of document segments; a segment representation compression module configured to compress respective feature representations of the plurality of document segments based on the respective compression ratios for the plurality of document segments to obtain a compressed feature representation of the candidate document; and an answer determination module configured to determine a target answer to the target question based on the compressed feature representation of the candidate document using a trained target model.

In a third aspect of the present disclosure, an electronic device is provided. The electronic device includes at least one processing unit; and at least one memory coupled to the at least one processing unit and storing instructions executable by the at least one processing unit, wherein the instructions, when executed by the at least one processing unit, cause the electronic device to perform the method of the first aspect of the present disclosure.

In a fourth aspect of the present disclosure, a computer-readable storage medium is provided. The computer-readable storage medium has stored thereon a computer program which is executable by a processor to perform the method of the first aspect of the present disclosure.

It should be understood that the content described in the Summary section is not intended to limit key features or important features of the embodiments of the present disclosure, nor is it intended to limit the scope of the present disclosure. Other features of the present disclosure will become readily understandable through the following description.

BRIEF DESCRIPTION OF THE DRAWINGS

Hereinafter, the above and other features, advantages, and aspects of the implementations of the present disclosure will become more apparent with reference to the following detailed description and in conjunction with the accompanying drawings. In the drawings, the same or similar reference numerals denote the same or similar elements, where.

DETAILED DESCRIPTION OF EMBODIMENTS

Figure 1:
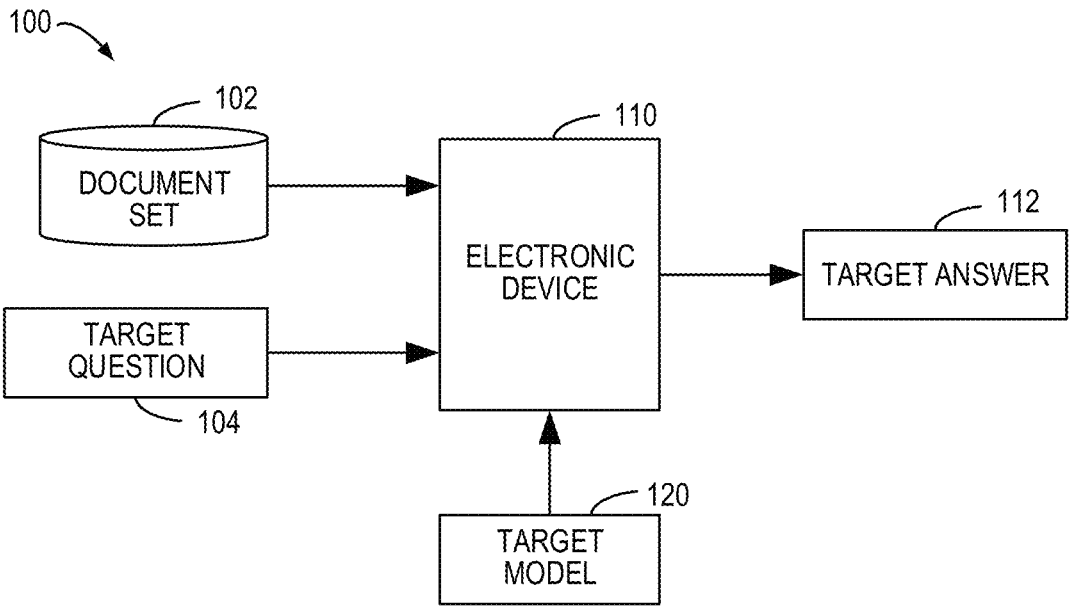
FIG. 1 shows a schematic diagram of an example environment in which embodiments of the present disclosure can be implemented.

Embodiments of the present disclosure will be described in more detail below with reference to the accompanying drawings. Although some embodiments of the present disclosure are shown in the drawings, it should be understood that the present disclosure may be implemented in various forms and should not be construed as being limited to the embodiments set forth herein. Rather, these embodiments are provided for a more thorough and complete understanding of the present disclosure. It should be understood that the drawings and embodiments of the present disclosure are only for exemplary purposes, and are not intended to limit the scope of protection of the present disclosure.

In the description of the embodiments of the present disclosure, the term "include/comprise" and similar terms should be understood as an open inclusion, that is, "include/comprise but not limited to". The term "based on" should be understood as "at least partially based on". The term "an embodiment" or "the embodiment" should be understood as "at least one embodiment". The term "some embodiments" should be understood as "at least some embodiments". Other explicit and implicit definitions may also be included below.

Herein, unless explicitly stated otherwise, performing a step "in response to A" does not mean to perform the step immediately after "A", but may include one or more intermediate steps.

It would be appreciated that the data involved in the technical solutions of the present disclosure (including but not limited to the data itself, the acquisition, use, storage, or deletion of the data) shall comply with the requirements of corresponding laws, regulations, and relevant provisions.

It would be appreciated that before using the technical solutions disclosed in the embodiments of the present disclosure, the types, scope of use, use scenarios, etc. of information involved in the present disclosure shall be informed to and authorized by the related users in an appropriate manner in accordance with the relevant laws and regulations. The related users may include any type of right subjects, such as individuals, enterprises, and groups.

For example, when receiving an active request from a user, a prompt message is sent to the related user to explicitly prompt the related user that the operation requested by the user will need to obtain and use information of the related user, so that the related user can choose whether to provide information to software or hardware such as an electronic device, an application, a server, or a storage medium that performs the operation of the technical solution of the present disclosure according to the prompt message.

As an optional but non-restrictive implementation, in response to receiving an active request from a related user, the prompt message is sent to the related user, for example, in the form of a pop-up window, and the prompt message may be presented in the form of text in the pop-up window. In addition, the pop-up window may also carry a selection control for the user to choose "agree" or "disagree" to provide information to the electronic device.

It would be appreciated that the above process of notifying and obtaining the user authorization is merely illustrative, and does not constitute a limitation to the implementation of the present disclosure, and other methods that meet the relevant laws and regulations may also be applied to the implementation of the present disclosure. The enabling of the related functions of the digital assistant in the embodiments of the present disclosure, the data obtained, the data processing and storage methods, etc., shall be pre-authorized by the user and other right subjects associated with the user, and shall comply with the relevant laws and regulations and the agreement of the protocol rules between the right subjects.

As used herein, the term "model" may learn a corresponding association relationship between an input and an output from training data, so that after the training is completed, a corresponding output may be generated for a given input. The generation of the model may be based on machine learning techniques. Deep learning is a machine learning algorithm that processes input and provides a corresponding output using multiple-layer processing units. A neural network model is an example of a deep learning-based model. Herein, "model" may also be referred to as "machine learning model", "learning model", "machine learning network", or "learning network", which terms are used interchangeably herein.

FIG. 1 shows a schematic diagram of an example environment 100 in which embodiments of the present disclosure can be implemented. In the environment 100, an electronic device 110 may obtain a document set 102 and a target question 104. The document set 102 may include a plurality of documents. The document set is sometimes also referred to as a document library, a knowledge base, or the like. The documents herein may be in any appropriate format (including but not limited to doc, pdf, txt, etc.). The documents herein may include data information of any appropriate type (including but not limited to text, pictures, tables, etc.). Although a single document set is shown, there may be actually a plurality of document sets. The target question 104 may indicate, for example, querying data associated with the document set 102.

The electronic device 110 may generate a target answer 112 to the target question 104 based on the plurality of documents included in the document set 102 and the target question 104. The target answer 112 may include, for example, at least some content in the plurality of documents included in the document set 102, and the at least some content matches the target question 104. The target answer 112 may also be new content generated based on one or more documents in the document set 102.

In some embodiments, the electronic device 110 may generate the corresponding target answer 112 based on the plurality of documents included in the document set 102 and the target question 104 using a target model 120. The target model 120 may include one or more models. The target model 120 may run locally on the electronic device 110 or on another electronic device (such as a remote server). In some embodiments, the target model 120 may be a machine learning model, a deep learning model, a learning model, a neural network, or the like. In some embodiments, the model may be based on a language model (LM). By learning from a large amount of corpora, the language model can accurately understand semantics of data in a text modality and/or other modalities, so that it can have a question answering capability. The target model 120 may also be based on other appropriate models.

The electronic device 110 may be any type of device with a computing capability, including a terminal device or a server device. The terminal device may be any type of mobile terminal, fixed terminal, or portable terminal, including a mobile phone, a desktop computer, a laptop computer, a notebook computer, a netbook computer, a tablet computer, a media computer, a multimedia tablet, a personal communication system (PCS) device, a personal navigation device, a personal digital assistant (PDA), an audio/video player, a digital camera/camcorder, a positioning device, a TV receiver, a radio broadcast receiver, an e-book device, a gaming device, or any combination thereof, including accessories and peripherals of these devices, or any combination thereof. The server device may include, for example, a computing system/server, such as a mainframe, an edge computing node, a computing device in a cloud environment, and the like.

It should be understood that the structure and functions of the environment 100 are described for exemplary purposes only, without implying any limitation on the scope of the present disclosure.

As mentioned above, how to improve the quality of query services provided to users is a concern. Conventionally, a prompt input for a language model is usually directly constructed based on a document and a target question, and the prompt input is provided to the language model. A model output of the language model for the prompt input may be obtained, and a target answer to the target question is determined based on the model output. However, if the content of the document is large, the prompt input is long. The overlong prompt input results in high computing cost of the model and increases computing time, which may result in low computing efficiency.

In addition, the overlong prompt input also affects the correctness of the model output. On the one hand, since the language model usually can only pay attention to the beginning and end positions and ignore the middle position, if the correct answer appears in the middle position of the prompt input, the language model may not be able to output the correct model output. On the other hand, the overlong prompt input may be accompanied by more noise, which will also affect the correctness of the model output of the language model.

In view of this, the embodiments of the present disclosure provide an improved solution for document query. In the solution, for a candidate document of a target question, a plurality of importance degrees of a plurality of document segments in the candidate document relative to the target question are determined. Respective compression ratios for the plurality of document segments are determined based on respective importance degrees of the plurality of document segments. A feature representation of each of the plurality of document segments is compressed based on the respective compression ratio for each of the plurality of document segments to obtain a compressed feature representation of the candidate document. A target answer to the target question is determined based on the compressed feature representation of the candidate document using a trained target model.

In this way, the feature representation compression with different compression ratios may be performed on the segments in the document based on the importance degrees, to implement finer-grained adaptive document compression. The size of the model input is reduced by compression, and in the meanwhile, information loss caused by excessive compression of important information is avoided. This helps improve the efficiency and accuracy of document query.

Some example embodiments of the present disclosure will be described below with reference to the accompanying drawings.

Figure 2:
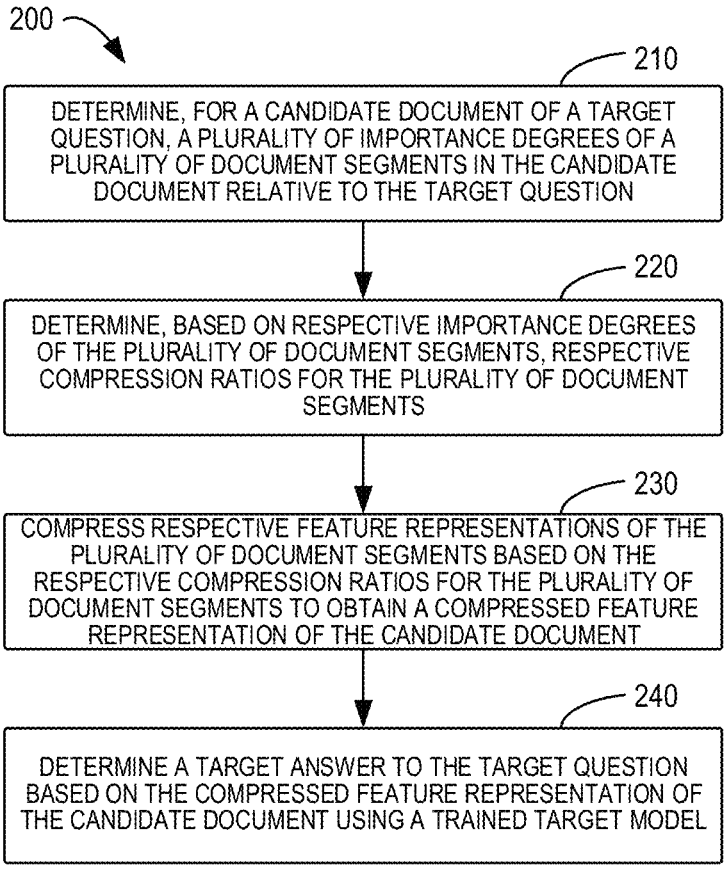
FIG. 2 shows a flowchart of a process for document query according to some embodiments of the present disclosure.

FIG. 2 shows a flowchart of a process 200 for document query according to some embodiments of the present disclosure. For ease of discussion, the process 200 will be described with reference to the environment 100 of FIG. 1. The process 200 may be implemented at the electronic device 110. As mentioned above, the electronic device 110 may be a server device or a terminal device, and the scope of the embodiments of the present disclosure is not limited thereto.

At block 210, the electronic device 110 determines, for a candidate document of a target question, a plurality of importance degrees of a plurality of document segments in the candidate document relative to the target question. The candidate document herein may include at least one document determined by the electronic device 110 from a document set 102.

Regarding a specific manner of determining the candidate document, in some embodiments, the electronic device 110 may determine an importance degree of each document in the document set 102 relative to the target question. The electronic device 110 may determine the importance degree of each document relative to the target question in any appropriate manner. For example, the electronic device 110 may determine the importance degree of each document relative to the target question based on a predetermined rule or algorithm. For example, the electronic device 110 may also determine the importance degree of each document relative to the target question with the aid of a model. The electronic device 110 may then select, from the document set based on the importance degree of each document in the document set, the candidate document for the target question.

Figure 3:
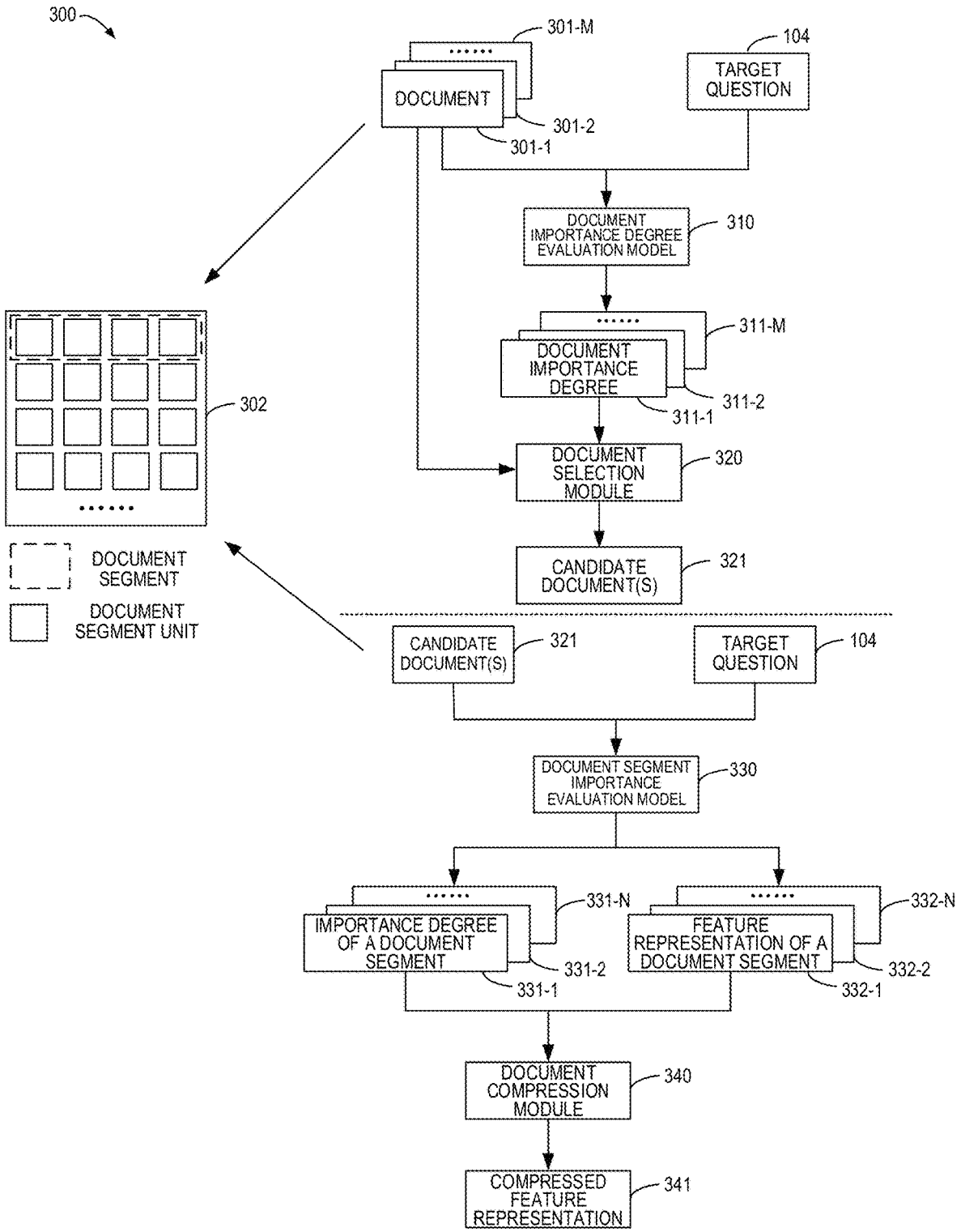
FIG. 3 shows a schematic diagram of an example architecture of determining a candidate document and determining a compressed feature representation according to some embodiments of the present disclosure.

FIG. 3 shows a schematic diagram of an example architecture 300 of determining a candidate document and determining a compressed feature representation according to some embodiments of the present disclosure. The architecture 300 may be implemented at the electronic device 110. The architecture 300 may include a document importance evaluation model 310 (which may also be referred to as the model 310 for short) and a document selection module 320.

As shown in FIG. 3, the document set 102 may include a plurality of documents 301 (which may include, for example, documents 301-1, 301-2, . . . , 301-M, where M is a positive integer greater than 1, and hereinafter one or more documents may be collectively referred to as the documents 301). The electronic device 110 may provide the plurality of documents 301 and the target question 104 to the trained model 310. A model output of the trained model 310 may indicate a plurality of document importance degrees 311 corresponding to the plurality of documents 301 (for example, may include a document importance degree 311-1 corresponding to the document 301-1, a document importance degree 311-2 corresponding to the document 301-2, . . . , and a document importance degree 311-M corresponding to the document 301-M, where M is a positive integer greater than 1, and hereinafter one or more importance degrees of the documents may be collectively referred to as the document importance degrees 301).

Regarding a training manner of the model 310, in some embodiments, the model 310 may include a plurality of network layers. The model 310 may include, for example, at least one (for example, 3) first network layer. The at least one first network layer herein may be continuous (that is, an output of a previous first network layer may be an input of a next first network layer). The first network layer may respectively process the document 301 and the target question 104 to obtain a plurality of document feature representations corresponding to the plurality of documents 301 and a question feature representation corresponding to the target question 104. The model 310 may calculate a similarity between each of the plurality of document feature representations and the question feature representation. For example, the model 310 may calculate a similarity between the plurality of document feature representations and the question feature representation based on a mean value of the plurality of document feature representations and a mean value of the question feature representation. For example, the model 310 may determine a contrastive learning (InfoNCE) loss between the plurality of document feature representations and the question feature representation based on the calculated similarity, and train based on the contrastive learning loss.

For example, the model 310 may further include at least one second network layer. The at least one second network layer herein may also be continuous. For example, the at least one second network layer may be located after the at least one first network layer. The second network layer may determine, for example, a cross entropy (CE) loss corresponding to the generated answer based on the attention mechanism in combination with the plurality of document feature representations and the question feature representation. The model 310 may be trained by reducing the two losses of the contrastive learning loss and the cross entropy loss and enhancing with negative sampling and other strategies. It should be noted that the model 310 may be trained at the electronic device 110 or at another electronic device.

The plurality of document importance degrees 311 corresponding to the plurality of documents 301 are provided to the document selection module 320. The document selection module 320 may select one or more candidate documents 321 for the target question 104 from the plurality of documents 301 based on the plurality of document importance degrees 311, according to a predetermined rule. In some embodiments, the document selection module 320 may obtain a predetermined threshold. This predetermined threshold may be predefined. The document selection module 320 may determine, based on a comparison result between each of the importance degrees 311 of the plurality of documents and the predetermined threshold, one or more documents whose corresponding document importance degrees 311 are higher than the predetermined threshold. The document selection module 320 may determine the one or more documents as the one or more candidate documents 321 (that is, for any candidate document, the corresponding document importance degree 311 be higher than the predetermined threshold).

In some other embodiments, the document selection module 320 may further sort the plurality of documents 301 based on the plurality of document importance degrees 311 (for example, sort the plurality of documents 301 in descending order, the document 301 with a higher corresponding document importance degree 311 has a higher ranking result, and the document 301 with a lower corresponding document importance degree 311 has a lower ranking result). For example, the document selection module 320 may determine, from the plurality of documents 301 based on the ranking result of the plurality of documents 301, a predetermined number of documents with the highest corresponding document importance degrees 311 (for example, the predetermined number of documents with the highest ranking results). The document selection module 320 may determine the predetermined number of documents as the one or more candidate documents 321.

In some embodiments, while obtaining the candidate document for the target question, the electronic device 110 may also obtain a plurality of importance degrees of a plurality of document segments in the candidate document relative to the target question. Exemplarily, as shown in FIG. 3, an output result of the model 310 may indicate not only the importance degrees 311 of the plurality of documents, but also the plurality of importance degrees of the plurality of document segments of each document. For example, for a document 302 (the document 302 may be any document in the plurality of documents 301), the document 302 may include a plurality of document segments, and each document segment may include at least one document segment unit. The model 310 may determine an importance degree of each document segment in the document 302 while determining a document importance degree 311 corresponding to the document 302.

For example, the model 310 may determine an importance degree of at least one document segment unit of the document 302, and determine an importance degree of a corresponding document segment based on the importance degree of the at least one document segment unit. The document segment unit may be a processing unit when the model 310 is processing the document 302, for example, it may be referred to as a token of the document or a text unit of the document, which may be in the form of a word or a phrase. The importance degree of each document segment may be, for example, a sum or a SHghted average of the importance degrees of the at least one document segment unit included therein. For example, as shown in FIG. 3, the importance degree of each document segment may be a sum of the importance degrees of 4 document segment units included therein. For example, the importance degree of each document segment may also be an average value of the importance degrees of the at least one document segment unit included therein. For example, as shown in FIG. 3, the importance degree of each document segment may be an average value of the importance degrees of 4 document segment units included therein. The present disclosure does not limit the relationship between the importance degree of the document segment and the importance degree of the at least one document segment unit included therein.

In this case, the electronic device 110 may determine, from an intermediate processing result of the model 310, the importance degree of each of the plurality of document segments of each candidate document 321 after one or more candidate documents 321 for the target question 104 are selected from the document set.

In some other embodiments, the electronic device 110 may also only obtain the candidate document, and the electronic device 110 may also determine the plurality of importance degrees of the plurality of document segments in each candidate document relative to the target question in any appropriate manner. For example, the electronic device 110 may determine the plurality of importance degrees of the plurality of document segments in each candidate document relative to the target question based on a predetermined rule or algorithm. For example, the electronic device 110 may also determine the plurality of importance degrees of the plurality of document segments in each candidate document relative to the target question with the aid of a model. With reference to FIG. 3 again, in some embodiments, the architecture 300 may further include a document segment importance evaluation model 330 (which may also be referred to as the model 330 for short) and a document compression module 340. For each candidate document 321, the electronic device 110 may provide the candidate document 321 and the target question 104 to the model 330.

The model 330 and the model 310 may be the same model or different models. A training manner of the model 330 may refer to the training manner of the model 310, and will not be described again here. A model output of the trained model 330 may indicate a plurality of importance degrees 331 of a plurality of document segments in the candidate document 321 relative to the target question 104 (for example, it may include an importance degree 331-1, an importance degree 331-2, . . . , and an importance degree 331-N, where N is a positive integer greater than 1, and hereinafter one or more importance degrees may be collectively referred to as the importance degrees 331). For example, the model 330 may first determine an importance degree of at least one document segment unit of the candidate document, and determine an importance degree of a document segment based on the importance degree of the at least one document segment unit.

With reference back to FIG. 2, at block 220, the electronic device 110 determines, based on respective importance degrees of the plurality of document segments in the candidate document, respective compression ratios for the plurality of document segments of the candidate document.

In some embodiments, the electronic device 110 may determine a first compression ratio for a first document segment in the plurality of document segments and determine a second compression ratio for a second document segment in the plurality of document segments. If the importance degree of the first document segment is higher than that of the second document segment, the first compression ratio is lower than the second compression ratio. That is, the higher the importance degree of the corresponding document segment, the lower the compression ratio.

The electronic device 110 may determine the respective compression ratio for each of the plurality of document segments in any appropriate manner based on the respective importance degrees of the plurality of document segments. Exemplarily, with reference to FIG. 3, the plurality of importance degrees 331 of the plurality of document segments relative to the target question are provided to a document compression module 340. In some embodiments, for each candidate document 321, the document compression module 340 may further sort the plurality of document segments of the candidate document 321 based on the importance degrees 331 of the plurality of document segments (for example, sorting the plurality of document segments in descending order, the document segment with a higher corresponding importance degree 331 has a higher ranking result, and the document segment with a lower corresponding importance degree 331 has a lower ranking result). For example, the document compression module 340 may determine the respective compression ratio for each of the plurality of document segments based on the ranking result of the plurality of document segments.

For example, the document compression module 340 may determine a compression ratio of a first group of document segments with a maximum corresponding importance degree 331 (for example, document segments with importance degrees ranked at the top 20%) in the ranking result as a compression ratio A, determine a compression ratio of a second group of document segments with a minimum corresponding importance degree 331 (for example, document segments with importance degrees ranked at the bottom 40%) in the ranking result as a compression ratio B, and determine a compression ratio of document segments other than the first group of document segments and the second group of document segments (for example, document segments with importance degrees ranked at the middle 40%) in the plurality of document segments as a compression ratio C. In this case, the compression ratio A is less than the compression ratio C, and the compression ratio C is less than the compression ratio B. For example, if there are a total of 10 document segments, the document compression module 340 may determine the compression ratios of 2 document segments with the highest corresponding importance degrees 331 in the ranking result as 1 (that is, no compression is performed), determine the compression ratios of 4 document segments with the lowest corresponding importance degrees 331 in the ranking result as 4, and determine the compression ratios of the remaining 4 document segments in the plurality of document segments as 2.

In some other embodiments, the document compression module 340 may obtain a plurality of importance degree thresholds. The plurality of importance degree thresholds herein may all be predefined. Taking the plurality of importance degree thresholds including a first importance degree threshold and a second importance degree threshold, and the first importance degree threshold being higher than the second importance degree threshold as an example, for each document segment, if the corresponding importance degree 331 of the document segment is greater than or equal to the first importance degree threshold, the document compression module 340 may determine the compression ratio of the document segment as a compression ratio D. If the corresponding importance degree 331 of the document segment is greater than or equal to the second importance degree threshold and less than the first importance degree threshold, the document compression module 340 may determine the compression ratio of the document segment as a compression ratio E. If the corresponding importance degree 331 of the document segment is less than the second importance degree threshold, the document compression module 340 may determine the compression ratio of the document segment as a compression ratio F. In this case, the compression ratio D is less than the compression ratio E, and the compression ratio E is less than the compression ratio F.

At block 230, the electronic device 110 compresses respective feature representations of the plurality of document segments based on the respective compression ratios for the plurality of document segments to obtain a compressed feature representation of the candidate document. The feature representation of each of the plurality of document segments herein may be pre-converted. In this case, for example, the electronic device 110 may pre-perform feature conversion on the plurality of document segments to obtain the feature representation of each of the plurality of document segments. For example, the electronic device 110 may also directly obtain a feature representation of each of the plurality of document segments pre-converted by another electronic device.

In some embodiments, the feature representation of each of the plurality of document segments may also be obtained by the electronic device 110 in real time. For example, the electronic device 110 may determine the feature representation of each of the plurality of document segments while determining the plurality of importance degrees of the plurality of document segments relative to the target question.

With reference to FIG. 3 again, in some embodiments, if the model 310 may determine the importance degrees of the plurality of document segments of each of the plurality of documents 301 while determining the plurality of document importance degrees 311 corresponding to the plurality of documents 301, the model 310 may also determine a feature representation of each of the plurality of document segments of each of the plurality of documents 301. In some other embodiments, if the model 310 is only used to determine the document importance degrees 311, and the electronic device 110 further needs to determine the importance degrees 331 of the plurality of document segments of each candidate document 321 with the aid of the model 330, the model 330 may determine the feature representations 332 of the plurality of document segments (for example, may include a feature representation 332-1, a feature representation 332-2, . . . , and a feature representation 332-N, where N is a positive integer greater than 1, and hereinafter one or more feature representations 332 may be collectively referred to as the feature representations 332) while determining the importance degrees 331 of the plurality of document segments. Such a manner of determining the feature representations 332 of the plurality of document segments with the aid of the target question 104 may also be referred to as question-aware.

As described above, each document segment may include at least one document segment unit. In some embodiments, the number of document segment units included in each document segment may be the same. For example, each document segment includes a predetermined number of document segment units. Correspondingly, the feature representation corresponding to each document segment includes a predetermined number of feature representation units (one feature representation unit corresponds to one document segment unit).

The electronic device 110 may compress the feature representation of each of the plurality of document segments in any appropriate manner. Exemplarily, with reference to FIG. 3, for example, the document compression module 340 may perform, based on the compression ratio for each of the plurality of document segments, compression on the feature representation of each document segment by performing SHghting pooling on the predetermined number of feature representation units based on the importance degrees of the predetermined number of feature representation units to the target question. The SHght of each feature representation unit may be, for example, a value of the importance degree of the corresponding document segment unit for the target question determined above (which may also be referred to as an importance degree score). For example, if the compression ratio is 4 and each document segment includes 4 document segment units, and the feature representation units corresponding to the 4 document segment units are A, B, C, and D respectively, and the importance degree scores of the 4 document segment units for the target question are a, b, c, and d respectively, the compression result of this document segment may be $$\frac{aA + bB + cC + Dd}{4}.$$

For example, the document compression module 340 may also perform compression on the feature representation of each document segment by performing average pooling on the predetermined number of feature representation units, based on the respective compression ratio for each of the plurality of document segments. Exemplarily, if the compression ratio of a document segment is 2, and the document segment includes 4 document segment units, and the feature representation units corresponding to the 4 document segment units are A, B, C, and D respectively, the compression result of this document segment may be $$\frac{A+B}{2}, \frac{C+D}{2}.$$

Alternatively or additionally, for example, the document compression module 340 may also perform compression on the feature representation of each document segment by performing max pooling on the predetermined number of feature representation units, based on the respective compression ratio for each of the plurality of document segments. It should be noted that the document compression module 340 may also perform compression on the feature representation of each document segment in any other appropriate manner, which is not limited in the present disclosure.

Figure 4:
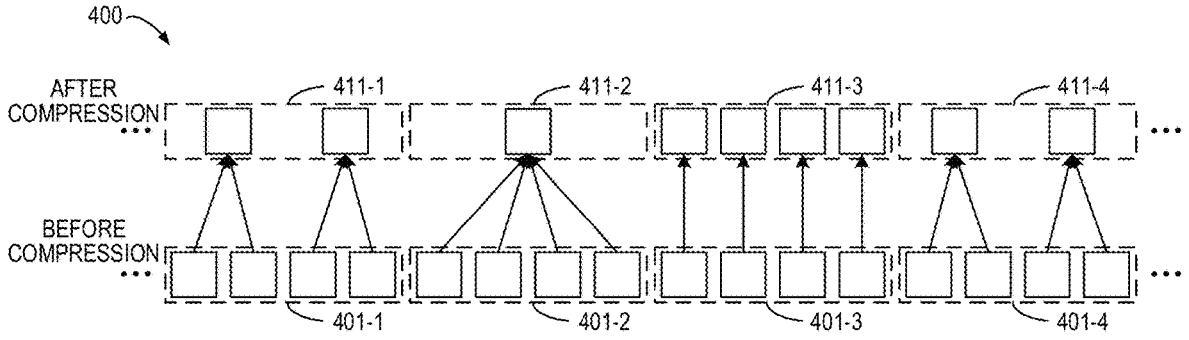
FIG. 4 shows a schematic diagram of an example of performing compression according to some embodiments of the present disclosure.

FIG. 4 shows a schematic diagram of an example 400 of performing compression according to some embodiments of the present disclosure. As shown in FIG. 4, if each document segment includes 4 document segment units (that is, the feature representation corresponding to each document segment includes 4 feature representation units), if the compression ratio of the document segments corresponding to the feature representation 401-1 and the feature representation 401-4 is 2, the corresponding compressed feature representations 411-1 and 411-4 may each include 2 compressed feature representation units, and each compressed feature representation unit corresponds to 2 feature representation units in the corresponding feature representation. If the compression ratio of the document segment corresponding to the feature representation 401-2 is 4, the corresponding compressed feature representation 411-2 may include only 1 compressed feature representation unit, and the 1 compressed feature representation unit corresponds to 4 feature representation units in the feature representation 401-1. If the compression ratio of the document segment corresponding to the feature representation 401-3 is 1, the corresponding compressed feature representation 411-3 may also include 4 compressed feature representation units, and each compressed feature representation unit corresponds to 1 feature representation unit in the feature representation 4013.

At block 240, the electronic device 110 determines a target answer to the target question based on the compressed feature representation of the candidate document using the trained target model.

In some embodiments, the electronic device 110 may construct a prompt input for the target model based on the one or more compressed feature representations and the target question. The electronic device 110 may then directly provide the prompt input to the target model. The target model may be, for example, a language model. The electronic device 110 may obtain a model output of the target model and determine the target answer to the target question based on the model output.

As mentioned above, the electronic device 110 may obtain one or more candidate documents. If there is only one candidate document, the electronic device 110 may directly construct the prompt input for the target model based on the compressed feature representation corresponding to this candidate document and the target question. If there are a plurality of candidate documents, the electronic device 110 may determine a compressed feature representation corresponding to each of the plurality of candidate documents. The electronic device 110 may then construct the prompt input for the target model based on the plurality of compressed feature representations corresponding to the plurality of candidate documents and the target question.

Figure 5:
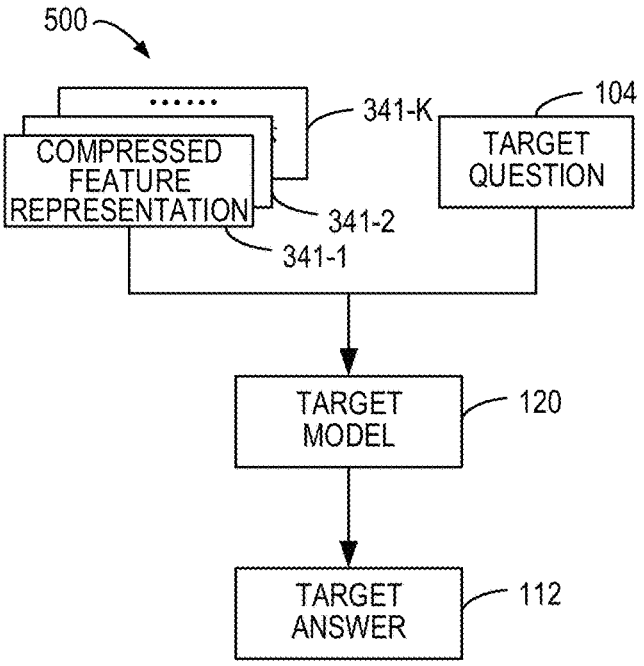
FIG. 5 shows a schematic diagram of an example process of determining a target answer according to some embodiments of the present disclosure.

An example of determining the target answer in the case where there are a plurality of candidate documents will be described below with reference to FIG. 5. FIG. 5 shows a schematic diagram of an example process 500 of determining a target answer according to some embodiments of the present disclosure. The electronic device 110 may determine a plurality of compressed feature representations 341 corresponding to the plurality of candidate documents 321 (for example, it may include a compressed feature representation 341-1, a compressed feature representation 341-2, . . . , and a compressed feature representation 341-K, where K is a positive integer greater than 1, and hereinafter one or more compressed feature representations may be collectively referred to as the compressed feature representations 341). The electronic device 110 may construct a prompt input for the target model 120 based on the plurality of compressed feature representations 341 and the target question 104. After the prompt input is provided to the target model 120, the target model 120 may output a model output for the prompt input. This model output may indicate the target answer 112 corresponding to the target question 102. For example, the electronic device 110 may determine the target answer 112 based on the model output.

In some embodiments, since the compressed feature representation after compression is not spatially aligned with the input feature representation of the target model, the electronic device 110 may also use a trained feature alignment model to convert the compressed feature representation into a converted feature representation. The feature alignment model is configured to perform feature alignment between the compressed feature representation and the input feature representation of the target model. The electronic device 110 may then determine the target answer to the target question based on the converted feature representation using the target model. Specifically, for example, the electronic device 110 may construct a converted prompt input for the target model based on the converted feature representation and the target question. The electronic device 110 may provide the converted prompt input to the target model. The electronic device 110 then obtains a converted model output for the converted prompt input from the target model and determines the target answer to the target question based on the converted model output.

Figure 6:
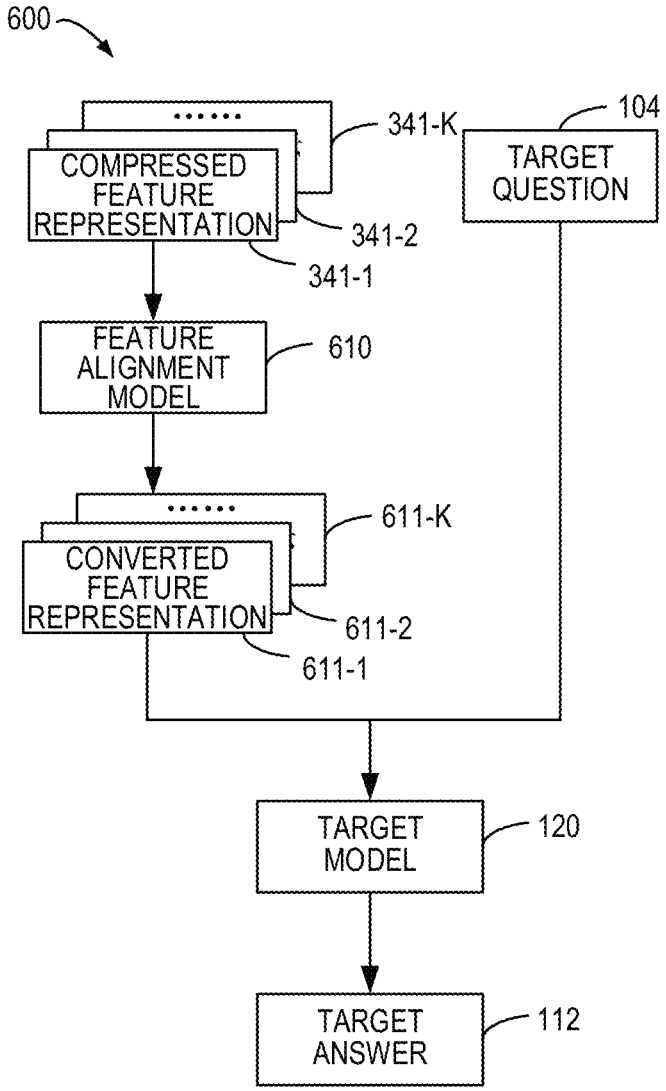
FIG. 6 shows a schematic diagram of an example process of determining a target answer according to some other embodiments of the present disclosure.

An example of converting the compressed feature representation into the converted feature representation using the trained feature alignment model will be described below with reference to FIG. 6. FIG. 6 shows a schematic diagram of an example process 600 of determining a target answer according to some other embodiments of the present disclosure. The electronic device 110 may determine a plurality of compressed feature representations 341 corresponding to the plurality of candidate documents 321. For example, the electronic device 110 may provide the plurality of compressed feature representations 341 to a trained feature alignment model 610. The feature alignment model 610 may convert the plurality of compressed feature representations 341 into a plurality of converted feature representations 611 that are spatially aligned with an input feature representation of the target model 120 (for example, it may include a converted feature representation 611-1, a converted feature representation 611-2, . . . , and a converted feature representation 611-K, where K is a positive integer greater than 1, and hereinafter one or more converted feature representations may be collectively referred to as the converted feature representations 611). The electronic device 110 may construct a converted prompt input for the target model 120 based on the plurality of converted feature representations 611 and the target question 104. After the converted prompt input is provided to the target model 120, the target model 120 may output a converted model output for the converted prompt input. This converted model output may indicate the target answer 112 corresponding to the target question 102. For example, the electronic device 110 may determine the target answer 112 based on the converted model output.

Regarding the feature alignment model, in some embodiments, in order to ensure the accuracy of the converted feature representation obtained by its conversion, it may be obtained through joint training with the target model. A loss function of the joint training may include, for example, a first loss. Regarding a specific determination manner of the first loss, in some embodiments, a training device (that is, a device that performs the joint training, which may be the electronic device 110 or another electronic device) may determine a first prediction answer for a first sample question based on a first sample candidate document using the target model and the feature alignment model. The training device may then determine the first loss based on a difference between the first prediction answer and a first ground-truth answer of the first sample question. The first ground-truth answer of the first sample question herein may be an answer labeled manually in advance, or an answer determined by another trained query model.

The loss function of the joint training may further include, for example, a second loss. Regarding a specific determination manner of the second loss, in some embodiments, the training device may determine a prediction answer for a second sample question based on an uncompressed second sample candidate document using the target model to obtain a first distribution of the prediction answer. The training device may also determine a prediction answer for the second sample question based on the compressed feature representation of the second sample candidate document using the target model and the feature alignment model to obtain a second distribution of the prediction answer. The training device may determine the second loss in the loss function based on a difference between the first distribution and the second distribution.

The target model that determines the prediction answer based on the uncompressed second sample candidate document herein may also be referred to as a teacher model, and the target model that determines the prediction answer based on the compressed feature representation of the second sample candidate document may also be referred to as a student model. That is, the first distribution is a distribution corresponding to the teacher model, and the second distribution is a distribution corresponding to the student model. In addition, the manner of comparing the difference between the two distributions herein may also be referred to as KL divergence. KL divergence may also be called relative entropy or information divergence. The theoretical significance of KL divergence is to measure the degree of difference between two probability distributions. The larger the KL divergence, the greater the degree of difference between the two; and when the KL divergence is small, the difference between the two is small. If the two are the same, the KL divergence should be 0. The second loss determined based on the KL divergence may also be referred to as knowledge distillation (KD) loss. That is, the training device may perform joint training based on the KD loss to align the feature spaces of the compressed feature representation and the input feature representation of the target model.

The loss function of the joint training may further include, for example, a third loss. Regarding a specific determination manner of the third loss, in some embodiments, the training device may obtain a masked third sample question by performing masking on a part of a third sample question. The training device may then determine a third prediction answer for the masked third sample question based on the compressed feature representation of a third sample candidate document using the target model and the feature alignment model. The training device may determine the third loss based on a difference between the third prediction answer and a third ground-truth answer of the third sample question. The third ground-truth answer herein may be an answer labeled manually in advance, or an answer determined by another trained query model. In some embodiments, the third ground-truth answer herein may also be an answer determined by the target model and the feature alignment model for the unmasked third sample question based on the compressed feature representation of the third sample candidate document. Therefore, the training device may train the target model and the feature alignment model by reducing the third loss.

It should be noted that the training device may determine one or more of the foregoing first loss, second loss, and third loss, and jointly train the target model and the feature alignment model based on the determined one or more losses. In addition, the training device may also determine any other appropriate loss, and the present disclosure is not limited to the specific loss.

In conclusion, in the embodiments of the present disclosure, the feature representation compression with different compression ratios may be performed on the document segments based on the importance degrees, to implement finer-grained adaptive document compression. The size of the model input is reduced by compression, and in the meanwhile, information loss caused by excessive compression of important information is avoided. This helps improve the efficiency and accuracy of document query.

Figure 7:
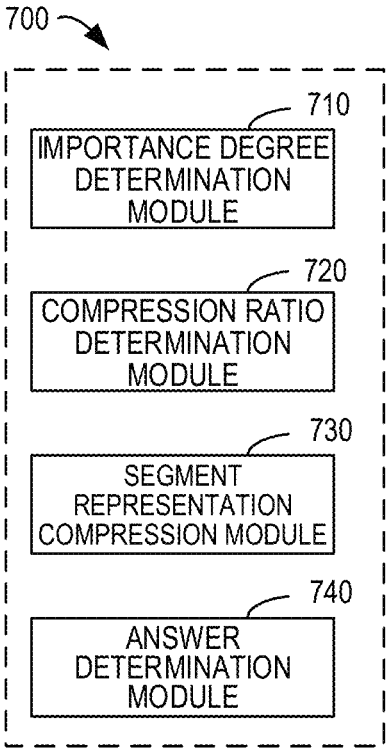
FIG. 7 shows a block diagram of an apparatus for document query according to some embodiments of the present disclosure.

Embodiments of the present disclosure further provide a corresponding apparatus for implementing the above method or process. FIG. 7 shows a block diagram of an apparatus 700 for document query according to some embodiments of the present disclosure. The apparatus 700 may be implemented as or included in the electronic device 110. Each module/component in the apparatus 700 may be implemented by hardware, software, firmware, or any combination thereof.

As shown in FIG. 7, the apparatus 700 includes an importance degree determination module 710 configured to determine, for a candidate document of a target question, a plurality of importance degrees of a plurality of document segments in the candidate document relative to the target question. The apparatus 700 further includes a compression ratio determination module 720 configured to determine, based on respective importance degrees of the plurality of document segments, respective compression ratios for the plurality of document segments. The apparatus 700 further includes a segment representation compression module 730 configured to compress respective feature representations of the plurality of document segments based on the respective compression ratios for the plurality of document segments to obtain a compressed feature representation of the candidate document. The apparatus 700 further includes an answer determination module 740 configured to determine a target answer to the target question based on the compressed feature representation of the candidate document using a trained target model.

In some embodiments, the compression ratio determination module 720 is specifically configured to: determine a first compression ratio for a first document segment in the plurality of document segments and determine a second compression ratio for a second document segment in the plurality of document segments, where the importance degree of the first document segment is higher than that of the second document segment, and the first compression ratio is lower than the second compression ratio.

In some embodiments, the feature representation corresponding to each document segment includes a predetermined number of feature representation units, and the segment representation compression module 730 is specifically configured to: perform compression on the feature representation of each document segment by one of the following based on the respective compression ratio for each of the plurality of document segments: performing average pooling on the predetermined number of feature representation units, performing SHghting pooling on the predetermined number of feature representation units based on the importance degrees of the predetermined number of feature representation units to target question, and performing max pooling on the predetermined number of feature representation units.

In some embodiments, the answer determination module 740 includes: a prompt input construction module configured to construct a prompt input for the target model based on the compressed feature representation and the target question; an input providing module configured to provide the prompt input to the target model to obtain a model output of the target model; and a first answer determination module configured to determine the target answer to the target question based on the model output.

In some embodiments, the answer determination module 740 includes: a conversion module configured to use a trained feature alignment model to convert the compressed feature representation into a converted feature representation, where the feature alignment model is configured to perform feature alignment between the compressed feature representation and an input feature representation of the target model; and a second answer determination module configured to determine the target answer to the target question based on the converted feature representation using the target model.

In some embodiments, the feature alignment model is obtained through joint training with the target model, where a loss function of the joint training includes a first loss, and the first loss is based on the following: determining a first prediction answer for a first sample question based on a first sample candidate document using the target model and the feature alignment model; and determining the first loss based on a difference between the first prediction answer and a first ground-truth answer of the first sample question.

In some embodiments, the loss function includes a second loss, and the second loss is determined by: determining a prediction answer for a second sample question based on an uncompressed second sample candidate document using the target model to obtain a first distribution of the prediction answer; determining a prediction answer for the second sample question based on the compressed feature representation of the second sample candidate document using the target model and the feature alignment model to obtain a second distribution of the prediction answer; and determining the second loss in the loss function based on a difference between the first distribution and the second distribution.

In some embodiments, the loss function includes a third loss, and the third loss is determined by: obtaining a masked third sample question by performing masking on a part of a third sample question; determining a third prediction answer for the masked third sample question based on the compressed feature representation of a third sample candidate document using the target model and the feature alignment model; and determining the third loss based on a difference between the third prediction answer and a third ground-truth answer of the third sample question.

In some embodiments, the apparatus 700 further includes: a determination module configured to determine an importance degree of each document in a document set relative to the target question; and a document selection module configured to select the candidate document for the target question from the document set based on the importance degree of each document in the document set.

In some embodiments, the answer determination module 740 includes: a compression representation determination module configured to determine, in response to a plurality of candidate documents for the target question being selected from the document set, a compressed feature representation for each of the plurality of candidate documents; and a third answer determination module configured to determine the target answer to the target question based on the compressed feature representation of each of the plurality of candidate documents using the target model.

The units and/or modules included in the apparatus 700 may be implemented in various manners, including software, hardware, firmware, or any combination thereof. In some embodiments, one or more units and/or modules may be implemented using software and/or firmware, for example, machine-executable instructions stored in a storage medium. In addition to or as an alternative to the machine-executable instructions, some or all of the units and/or modules in the apparatus 700 may be implemented at least partially by one or more hardware logic components. By way of example, but not limitation, exemplary types of hardware logic components that may be used include a field programmable gate array (FPGA), an application-specific integrated circuit (ASIC), an application-specific standard product (ASSP), a system on a chip (SOC), a complex programmable logic device (CPLD), and the like.

Figure 8:
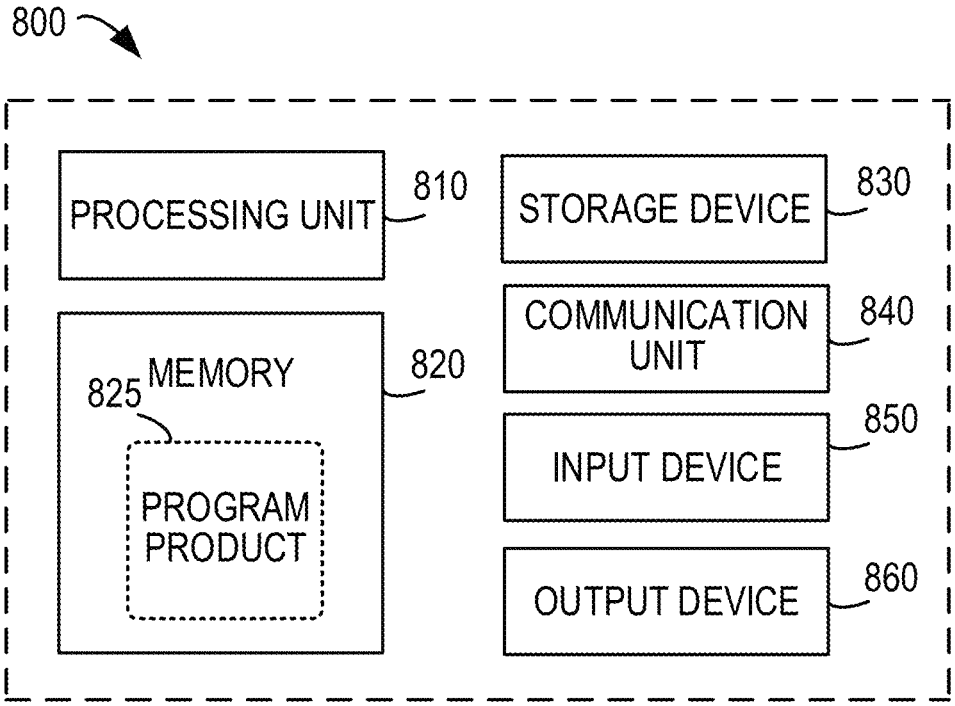
FIG. 8 shows a block diagram of an electronic device in which one or more embodiments of the present disclosure may be implemented.

FIG. 8 shows a block diagram of an electronic device 800 in which one or more embodiments of the present disclosure may be implemented. It should be understood that the electronic device 800 shown in FIG. 8 is merely an example, and should not constitute any limitation on the function and scope of the embodiments described herein. The electronic device 800 shown in FIG. 8 may be used to implement the electronic device 110 of FIG. 1 or the apparatus 700 of FIG. 7.

As shown in FIG. 8, the electronic device 800 is in the form of a general-purpose electronic device. Components of the electronic device 800 may include, but are not limited to, one or more processors or processing units 810, a memory 820, a storage device 830, one or more communication units 840, one or more input devices 850, and one or more output devices 860. The processing unit 810 may be a physical or virtual processor and can perform various processes based on a program stored in the memory 820. In a multi-processor system, a plurality of processing units execute computer-executable instructions in parallel to improve the parallel processing capability of the electronic device 800.

The electronic device 800 generally includes a plurality of computer storage media. Such media may be any available media accessible by the electronic device 800, including but not limited to volatile and non-volatile media, removable and non-removable media. The memory 820 may be a volatile memory (for example, a register, a cache, a random access memory (RAM)), a non-volatile memory (for example, a read-only memory (ROM), an electrically erasable programmable read-only memory (EEPROM), or a flash memory), or any combination thereof. The storage device 830 may be a removable or non-removable medium, and may include a machine-readable medium, such as a flash drive, a disk, or any other medium that can be used to store information and/or data and can be accessed in the electronic device 800.

The electronic device 800 may further include other removable/non-removable, volatile/non-volatile storage media. Although not shown in FIG. 8, a disk drive for reading from or writing to a removable, non-volatile disk (such as a "floppy disk") and an optical disk drive for reading from or writing to a removable, non-volatile optical disk can be provided. In these cases, each drive may be connected to a bus (not shown) through one or more data medium interfaces. The memory 820 may include a computer program product 825, which has one or more program modules, and the program modules are configured to perform various methods or actions of various embodiments of the present disclosure.

The communication unit 840 communicates with other electronic devices through a communication medium. In addition, the functions of the components of the electronic device 800 may be implemented by a single computing cluster or multiple computing machines that can communicate through a communication connection. Therefore, the electronic device 800 can operate in a networked environment using a logical connection with one or more other servers, network personal computers (PCs), or another network node.

The input device 850 may be one or more input devices, such as a mouse, a keyboard, and a trackball. The output device 860 may be one or more output devices, such as a display, a speaker, and a printer. The electronic device 800 may further communicate with one or more external devices (not shown) as required through the communication unit 840, where the external devices such as a storage device and a display device, communicate with one or more devices that enable a user to interact with the electronic device 800, or communicate with any device (for example, a network card and a modem) that enables the electronic device 800 to communicate with one or more other electronic devices. Such communication may be performed via an input/output (I/O) interface (not shown).

According to an exemplary implementation of the present disclosure, there is provided a computer-readable storage medium having stored thereon computer-executable instructions, where the computer-executable instructions, when executed by a processor, implement the method described above. According to an exemplary implementation of the present disclosure, there is further provided a computer program product, which is tangibly stored on a non-transitory computer-readable medium and includes computer-executable instructions, and the computer-executable instructions, when executed by a processor, implement the method described above.

Various aspects of the present disclosure are described here with reference to the flowcharts and/or the block diagrams of the method, the apparatus, the device, and the computer program product implemented according to the present disclosure. It should be understood that each block of the flowchart and/or the block diagram and a combination of the blocks in the flowchart and/or the block diagram may be implemented by computer-readable program instructions.

These computer-readable program instructions may be provided to a processing unit of a general-purpose computer, a special computer, or another programmable data processing apparatus to produce a machine, such that the instructions, when executed by the processing unit of the computer or another programmable data processing apparatus, create an apparatus for implementing the functions/acts specified in one or more blocks in the flowchart and/or the block diagram. These computer-readable program instructions may also be stored in a computer-readable storage medium. These instructions enable a computer, a programmable data processing apparatus, and/or another device to work in a specific manner. Therefore, the computer-readable medium storing the instructions includes a product manufactured, which includes instructions for implementing various aspects of the functions/acts specified in one or more blocks in the flowchart and/or the block diagram.

The computer-readable program instructions may be loaded onto a computer, another programmable data processing apparatus, or another device, such that a series of operation steps are performed on the computer, the another programmable data processing apparatus, or the another device, to produce a computer-implemented process. Therefore, the instructions executed on the computer, the another programmable data processing apparatus, or the another device implement the functions/acts specified in one or more blocks in the flowchart and/or the block diagram.

The flowcharts and the block diagrams in the accompanying drawings illustrate the possibly implemented architecture, functions, and operations of the system, the method, and the computer program product according to a plurality of implementations of the present disclosure. In this regard, each block in the flowchart or the block diagram may represent a module, program segment, or part of an instruction, and the module, program segment, or part of an instruction contains one or more executable instructions for implementing the specified logical functions. In some alternative implementations, the functions marked in the blocks may also occur in an order different from that marked in the accompanying drawings. For example, two blocks shown in succession may actually be performed substantially in parallel, or may sometimes be performed in a reverse order, depending on a function involved. It should also be noted that each block in the block diagram and/or the flowchart, and a combination of the blocks in the block diagram and/or the flowchart may be implemented by a dedicated hardware-based system that executes specified functions or acts, or may be implemented by a combination of dedicated hardware and computer instructions.

The foregoing describes various implementations of the present disclosure. The foregoing descriptions are exemplary, not exhaustive, and are not limited to the disclosed implementations. Many modifications and changes are obvious to those of ordinary skill in the art without departing from the scope and spirit of the described implementations. The selection of terms used herein is intended to best explain the principles, practical applications, or improvements to the technology in the market of the implementations, or to enable those of ordinary skill in the art to understand the implementations disclosed herein.

The invention claimed is:

1. A method for document query, comprising:

determining, for a candidate document of a target question, a plurality of importance degrees of a plurality of document segments in the candidate document relative to the target question;

determining, based on respective importance degrees of the plurality of document segments, respective compression ratios for the plurality of document segments;

compressing respective feature representations of the plurality of document segments based on the respective compression ratios for the plurality of document segments to obtain a compressed feature representation of the candidate document, the respective feature representations of the plurality of document segments being extracted from the plurality of document segments using a trained model; and determining a target answer to the target question based on the compressed feature representation of the candidate document using a trained target model, wherein determining the target answer to the target question based on the compressed feature representation of the candidate document comprises:

converting the compressed feature representation into a converted feature representation using a trained feature alignment model, wherein the feature alignment model is configured to perform feature alignment between compressed feature representations and input feature representations of the target model; and determining the target answer to the target question based on the converted feature representation using the target model, wherein the feature alignment model is obtained through joint training with the target model, wherein a loss function of the joint training comprises a first loss, and the first loss is based on the following:

determining a first prediction answer for a first sample question using the target model and the feature alignment model based on a first sample candidate document; and determining the first loss based on a difference between the first prediction answer and a first ground-truth answer of the first sample question.

2. The method of claim 1, wherein determining the respective compression ratios for the plurality of document segments comprises:

determining a first compression ratio for a first document segment in the plurality of document segments and determining a second compression ratio for a second document segment in the plurality of document segments, wherein the importance degree of the first document segment is higher than that of the second document segment, and the first compression ratio is lower than the second compression ratio.

3. The method of claim 1, wherein a feature representation corresponding to each document segment comprises a predetermined number of feature representation units, and compressing the respective feature representations of the plurality of document segments comprises:

compressing, based on the respective compression ratios for the plurality of document segments, the feature representation of each document segment by one of the following:

performing average pooling on the predetermined number of feature representation units;

performing weighted pooling on the predetermined number of feature representation units based on the importance degrees of the predetermined number of feature representation units to the target question; and performing max pooling on the predetermined number of feature representation units.

4. The method of claim 1, wherein determining the target answer to the target question based on the compressed feature representation comprises:

constructing a prompt input for the target model based on the compressed feature representation and the target question;

providing the prompt input to the target model to obtain a model output of the target model; and determining the target answer to the target question based on the model output.

5. The method of claim 1, wherein the loss function comprises a second loss, and the second loss is determined by:

determining, using the target model, a prediction answer for a second sample question based on an uncompressed second sample candidate document to obtain a first distribution of the prediction answer;

determining, using the target model and the feature alignment model, a prediction answer for the second sample question based on a compressed feature representation of the second sample candidate document, to obtain a second distribution of the prediction answer; and determining the second loss in the loss function based on a difference between the first distribution and the second distribution.

6. The method of claim 1, wherein the loss function comprises a third loss, and the third loss is determined by:

obtaining a masked third sample question by masking a part of a third sample question;

determining a third prediction answer for the masked third sample question using the target model and the feature alignment model based on a compressed feature representation of a third sample candidate document; and determining the third loss based on a difference between the third prediction answer and a third ground-truth answer of the third sample question.

7. The method of claim 1, further comprising:

determining an importance degree of each document in a document set relative to the target question; and selecting the candidate document for the target question from the document set based on the importance degree of each document in the document set.

8. The method of claim 7, wherein determining the target answer to the target question comprises:

in response to a plurality of candidate documents for the target question being selected from the document set, determining a compressed feature representation for each of the plurality of candidate documents; and determining the target answer to the target question based on respective compressed feature representations of the plurality of candidate documents using the target model.

9. An electronic device, comprising:

at least one processing unit; and at least one memory coupled to the at least one processing unit and storing instructions executable by the at least one processing unit, wherein the instructions, when executed by the at least one processing unit, cause the electronic device to perform acts comprising:

determining, for a candidate document of a target question, a plurality of importance degrees of a plurality of document segments in the candidate document relative to the target question;

determining, based on respective importance degrees of the plurality of document segments, respective compression ratios for the plurality of document segments;

compressing respective feature representations of the plurality of document segments based on the respective compression ratios for the plurality of document segments to obtain a compressed feature representation of the candidate document, the respective feature representations of the plurality of document segments being extracted from the plurality of document segments using a trained model; and determining a target answer to the target question based on the compressed feature representation of the candidate document using a trained target model, wherein determining the target answer to the target question based on the compressed feature representation of the candidate document comprises:

converting the compressed feature representation into a converted feature representation using a trained feature alignment model, wherein the feature alignment model is configured to perform feature alignment between compressed feature representations and input feature representations of the target model; and determining the target answer to the target question based on the converted feature representation using the target model, wherein the feature alignment model is obtained through joint training with the target model, wherein a loss function of the joint training comprises a first loss, and the first loss is based on the following:

determining a first prediction answer for a first sample question using the target model and the feature alignment model based on a first sample candidate document; and determining the first loss based on a difference between the first prediction answer and a first ground-truth answer of the first sample question.

10. The device of claim 9, wherein determining the respective compression ratios for the plurality of document segments comprises:

determining a first compression ratio for a first document segment in the plurality of document segments and determining a second compression ratio for a second document segment in the plurality of document segments, wherein the importance degree of the first document segment is higher than that of the second document segment, and the first compression ratio is lower than the second compression ratio.

11. The device of claim 9, wherein a feature representation corresponding to each document segment comprises a predetermined number of feature representation units, and compressing the respective feature representations of the plurality of document segments comprises:

compressing, based on the respective compression ratios for the plurality of document segments, the feature representation of each document segment by one of the following:

performing average pooling on the predetermined number of feature representation units;

performing weighted pooling on the predetermined number of feature representation units based on the importance degrees of the predetermined number of feature representation units to the target question; and performing max pooling on the predetermined number of feature representation units.

12. The device of claim 9, wherein determining the target answer to the target question based on the compressed feature representation comprises:

constructing a prompt input for the target model based on the compressed feature representation and the target question;

providing the prompt input to the target model to obtain a model output of the target model; and determining the target answer to the target question based on the model output.

13. The device of claim 9, wherein the loss function comprises a second loss, and the second loss is determined by:

determining, using the target model, a prediction answer for a second sample question based on an uncompressed second sample candidate document to obtain a first distribution of the prediction answer;

determining, using the target model and the feature alignment model, a prediction answer for the second sample question based on a compressed feature representation of the second sample candidate document, to obtain a second distribution of the prediction answer; and determining the second loss in the loss function based on a difference between the first distribution and the second distribution.

14. The device of claim 9, wherein the loss function comprises a third loss, and the third loss is determined by:

obtaining a masked third sample question by masking a part of a third sample question;

determining a third prediction answer for the masked third sample question using the target model and the feature alignment model based on a compressed feature representation of a third sample candidate document; and determining the third loss based on a difference between the third prediction answer and a third ground-truth answer of the third sample question.

15. The device of claim 9, wherein the acts further comprise:

determining an importance degree of each document in a document set relative to the target question; and selecting the candidate document for the target question from the document set based on the importance degree of each document in the document set.

16. A non-transitory computer-readable storage medium having a computer program stored thereon, wherein the computer program is executable by a processor to perform acts comprising:

determining, for a candidate document of a target question, a plurality of importance degrees of a plurality of document segments in the candidate document relative to the target question;

determining, based on respective importance degrees of the plurality of document segments, respective compression ratios for the plurality of document segments;

compressing respective feature representations of the plurality of document segments based on the respective compression ratios for the plurality of document segments to obtain a compressed feature representation of the candidate document, the respective feature representations of the plurality of document segments being extracted from the plurality of document segments using a trained model; and determining a target answer to the target question based on the compressed feature representation of the candidate document using a trained target model, wherein determining the target answer to the target question based on the compressed feature representation of the candidate document comprises:

converting the compressed feature representation into a converted feature representation using a trained feature alignment model, wherein the feature alignment model is configured to perform feature alignment between compressed feature representations and input feature representations of the target model; and determining the target answer to the target question based on the converted feature representation using the target model, wherein the feature alignment model is obtained through joint training with the target model, wherein a loss function of the joint training comprises a first loss, and the first loss is based on the following:

determining a first prediction answer for a first sample question using the target model and the feature alignment model based on a first sample candidate document; and determining the first loss based on a difference between the first prediction answer and a first ground-truth answer of the first sample question.

* * * * *